United States Patent [19]

Fee

[11] 4,210,281

[45] Jul. 1, 1980

[54] SPRING TYPE ANCHORS

[75] Inventor: Graham M. Fee, Geneva, Ohio

[73] Assignee: True Temper Corporation, Cleveland, Ohio

[21] Appl. No.: 939,124

[22] Filed: Sep. 5, 1978

[51] Int. Cl.[2] ..... E01B 13/02

[52] U.S. Cl. ..... 238/327 R; 238/315; 238/321

[58] Field of Search ..... 238/315, 321, 327 R, 238/327 A, 328, 322–326, 329, 330

[56] References Cited

U.S. PATENT DOCUMENTS

| | | | |
|---|---|---|---|
| 2,161,925 | 6/1939 | Johnson | 238/327 R |
| 2,446,842 | 8/1948 | McComb | 238/327 R |
| 2,491,052 | 12/1949 | McComb | 238/327 R |
| 2,936,127 | 5/1960 | Payne | 238/321 R |
| 3,173,611 | 3/1965 | Marimen | 238/327 R |
| 3,837,572 | 9/1974 | Van Sant | 238/315 |

FOREIGN PATENT DOCUMENTS

| | | | |
|---|---|---|---|
| 435067 | 11/1948 | Canada | 238/321 |
| 437689 | 11/1935 | United Kingdom | 238/327 R |

*Primary Examiner*—Randolph A. Reese

*Attorney, Agent, or Firm*—Squire, Sanders & Dempsey

[57] ABSTRACT

A one-piece spring-type rail anchor of substantially uniform wall thickness, for gripping the base of a rail having laterally projecting flanges, is comprised of a bowed throat portion, a pair of generally C-shaped members extending from opposing ends of the throat and adapted for engaging respectively opposite edges of the rail base, and a pair of bearing surfaces located at the junctures of the throat and C-shaped members for engaging the bottom of the base of the rail at spaced locations thereof, said rail anchor having a generally inverted U-shaped cross-section throughout.

10 Claims, 5 Drawing Figures

SPRING TYPE ANCHORS

The present invention relates to rail anchors and, more expecially, to spring-type rail anchors.

The prior art recognizes various types of rail anchors or rail-anchoring devices to prevent longitudinal creep of a rail when a train passes thereover. Rail anchors are typically applied to the base of the rail adjacent a cross-tie, with the faces of the anchor and tie in mating engagement. Because the tie is securely embedded in the ballast comprising the road bed, the rail is thus effectively force-coupled to the relatively stationary support. Consequently, any tendency for the rail to move or creep longitudinally when loaded during the passage of a train is transferred to the cross-tie itself whereby the rail is stabilized.

By virtue of the cooperative assembly of the rail, cross-tie and anchor, complex forces come to play under dynamic conditions in addition to the static forces existing between the rail and anchor including longitudinal forces due to expansion and contraction of the rail due to temperature changes. The anchor must be in firm engagement with the base of the rail under static conditions, and also be capable of transmitting the dynamic forces to the cross-tie; these latter dynamic forces including a torsional component on the ancor insofar as the same tends to tilt due to the forces exerted by a moving train. Thus, as a wheel approaches and passes over a tie, the rail rocks with respect to the tie while also tending to slide or creep longitudinally because of the traction or braking forces developed by the train. Optimally, the anchor should efficiently transmit dynamic forces without gouging or otherwise damaging the rail or tie, which would lead to premature failure thereof.

The operative dynamic forces, due to train motion, in addition to being complex, are sizable. The load imposed upon a rail anchor under typical conditions is cyclic in nature, normally reaching a maximum force when a wheel passes over the tie and an excessive force in the event of a derailment. Thus, the rail anchor must be capable of exerting substantial forces on the tie under any and all conditions of service and, desirably, maintain its operative engagement without contributing to any degradation of the track rail and/or tie.

Two types of rail anchors are typically employed in the prior art: jaw-type and spring-type rail anchors. Representative of the jaw-type rail anchors is the present inventor's prior U.S. Pat. No. 3,102,690, issued Sept. 3, 1963. Jaw-type anchors may be characterized, in their most essential aspects, as comprised of a reach member having a rail-base engaging portion and a terminal, generally C-shaped jaw for engaging one of the laterally projecting flanges of the rail base while the opposite end of the anchor is formed with a lip or a hook for gripping the opposite flange of the rail. Other illustrative jaw-type rail anchors are disclosed in the U.S. Pat. Nos. 2,717,740; 2,936,127; 3,044,709; 3,762,640 and Britist Pat. No. 437,689.

Exemplary of known spring-type rail anchors are the U.S. Pat. Nos. 2,446,842 and 2,491,052. The spring-type rail anchors are best characterized as differing from the jaw-type insofar as both ends of the center or rail-base engaging portion terminates in an upstanding segment, which may or may not be formed with a re-entrant geometry for contacting the upper side of the rail flange.

In the aforementioned U.S. Pat. No. 3,102,690, the present inventor describes a design which maximizes the holding power of the rail anchor, while simultaneously maximizing the ability to preclude longitudinal motion or creeping of the rails in active use (i.e., dynamically) without contributing to any damage of the rail as, for example, by gouging. In part, this may be attributed to a design wherein the rail anchor has a substantially U-shaped cross-section throughout and includes an upwardly curved connecting web in the throat portion joining a pair of substantially parallel side walls.

The need exists to provide an improved spring-type rail anchor which maximizes both the static and dynamic holding characteristics thereof.

In accordance with the aforementioned deficiencies of the prior art, it is a primary object of the present invention to provide a spring-type rail anchor of improved construction whereby the static and dynamic holding characteristics are maintained while employing relatively less metal in the anchor.

It is also an object of the present invention to provide a spring-type rail anchor having a greater tie bearing area than the prior art.

Another object of the invention is to provide relatively wide rail bearing areas as well as relatively wide tie bearing areas.

Still a further object of the invention is to provide a spring-type rail anchor having higher strength per unit weight.

Another object of the present invention is to provide an improved spring-type anchor which withstands rail rocking motion.

Still another object of the present invention is to provide a spring-type rail anchor of U-shaped cross section having substantially uniform wall thickness whereby forming and heat treatment results in desired metallurgical characteristics of the anchor.

It has now been determined, in accordance with the present invention, that the foregoing objects may be realized by providing a one-piece spring-type rail anchor of substantially uniform wall thickness, adapted to be secured to a rail, which anchor is comprised of a downwardly bowed throat portion, a pair of generally C-shaped members for engaging opposite ends of the rail base, which members extend from opposing ends of the throat, a pair of bearing surfaces for engaging the bottom of the base of the rail at spaced locations thereacross corresponding to the junctures between the C-shaped members and the throat, the rail anchor having a generally inverted U-shaped cross-sectional form throughout comprising a pair of substantially parallel side walls joined by a connecting web. Preferably, the rail bearing surfaces are flattened for engaging the bottom of the base of the rail and are provided with generally rounded edges, transversely merging into the side walls of the anchor. It is also preferable that the connecting web of the C-shaped members is likewise substantially flattened with rounded corners merging into the side walls, and the flat connecting web of the rail bearing surfaces longitudinally merges into the connecting web in the throat portion of the anchor and the web of said intermediate throat portion is provided with exteriorly rounded edges. It is preferred that the C-shaped members have an extended area of contact with the edges of the rail in order that the tilting of the anchor due to rocking of the rail is minimized without diminishing the holding power of the anchor.

Yet other objects and advantages of the present invention will become apparent to the skilled artisan upon examination of the following detailed description of the invention, taken in conjunction with the figures of drawings, wherein.

In order to more fully elucidate upon the various objects of advantages of the present invention, the same will now be described with reference to certain preferred embodiments thereof. However, the skilled artisan will appreciate that such a description of preferred embodiments is meant to be illustrative only, and is not to be deemed limitative.

Figure 2:
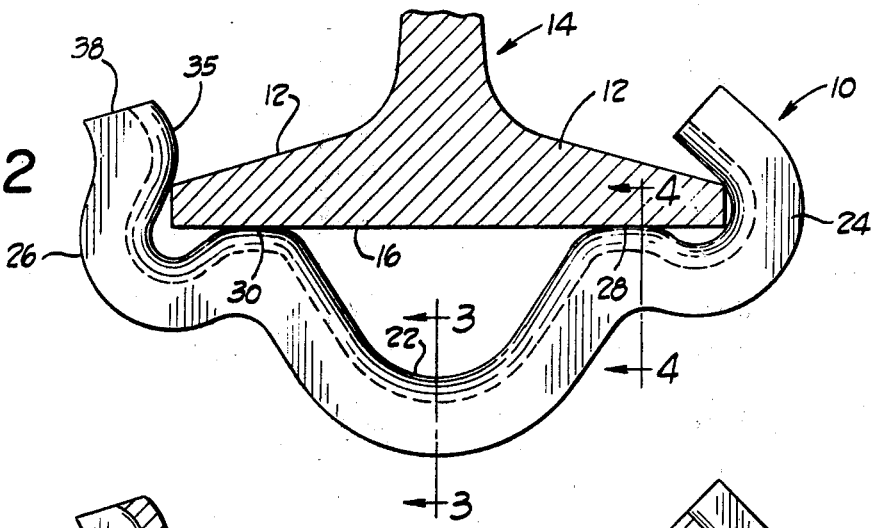
FIG. 2 is a side elevational view of the rail anchor of the present invention, showing the same applied to the base of a rail.
Figure 5:
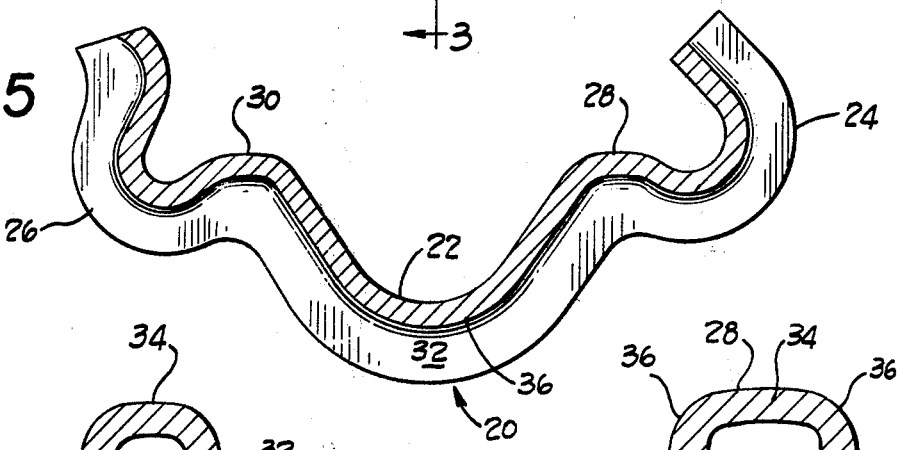
FIG. 5 is a side elevational view of the anchor alone.

Referring to the figures of drawings, in all of which like parts are designated by like reference characters, a rail anchor 10 is shown engaging the laterally projecting flanges 12 of a rail 14, as well as the base 16 thereof. The rail anchor 10 is comprised of a downwardly bowed throat portion 20, and a pair of generally C-shaped members 24 and 26 extending from opposing ends thereof. The member 24 is a hood-shaped member and 26 a latch member which are designed to engage the opposite laterally projecting flanges 12 of rail 14. Preferably, neither of the members 24, 26 substantially overlaps the upper surface of the base coming into contact with the upper faces thereof. Thus, as shown in FIG. 2, the members 24, 26 engage the upper edges of the flanges of the rail base. A pair of bearing surfaces 28 and 30 are located at the junctures of the C-shaped members 24 and 26 with the throat 20, and are adapted for engagement with the base 16 of the rail 14 at spaced locations thereacross. The rail anchor 10 has a generally U-shaped cross-section throughout, defined by a pair of generally parallel side walls 32 joined by a connecting web 34.

Figure 1:
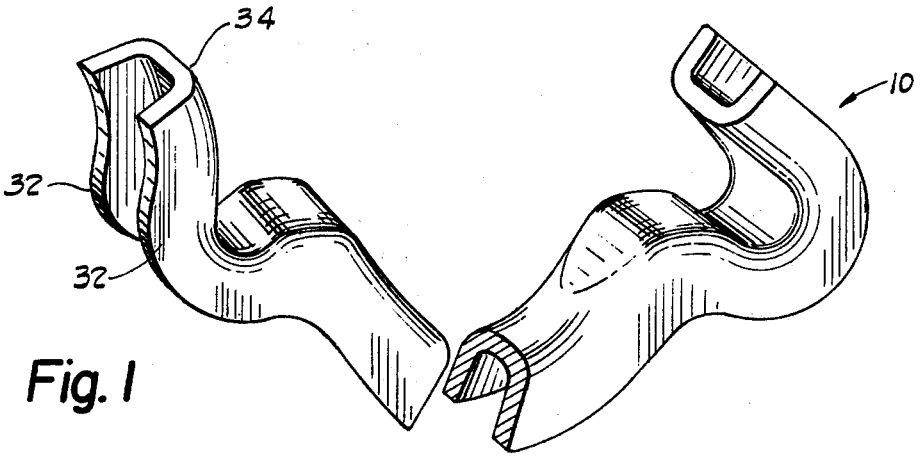
FIG. 1 is an isometric view of a rail anchor in accordance with the present invention.
Figure 3:
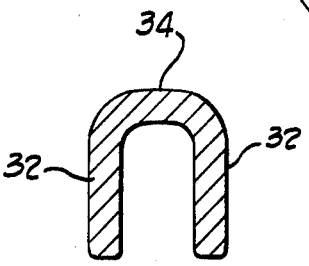
FIG. 3 is a cross-sectional view taken substantially along the line 3—3 of FIG. 2.
Figure 4:
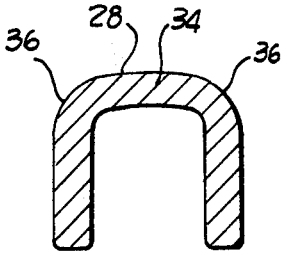
FIG. 4 is a sectional view taken substantially along the line 4—4 of FIG. 2.

In the embodiment shown, the bearing surfaces 28 and 30 are, most preferably, substantially flattened for engagement with the base 16 of rail 14. The connecting web 34 joins the side walls by transversely merging therewith at rounded edges 36 in order to prevent gouging of the rail under dynamic conditions, since the rail anchor tends to tilt under loading. That is, it is important to prevent any point contact with the rail, while it is highly desirable to present an extended dynamic surface for contact therewith; this being accomplished, in part, by virtue of the rounded edges 36. The generally flat connecting web 34 longitudinally merges into an upwardly curved arcuate connecting web in the throat portion, interiorly of the bearing surfaces 28 and 30, as best viewed in FIGS. 1 and 3. Again, the arcuate configuration of connecting web 34 provides an extended dynamic contact surface for bearing against the cross-tie adjacent the rail anchor 10.

The rail anchor 10 of the present invention is very easily fabricated, preferably from a flat bar steel stock. A preheated bar, having length and width dimensions suitable for fabricating a single anchor, may be readily bent or forged, first into the generally U-shaped cross-sectional configuration and, subsequently, into the form shown in FIG. 1, followed by appropriate quenching and further heat treatment. Because the side walls 32 and connecting web 34 are of substantially uniform wall thickness, the finished anchor is of uniform metallurgical properties.

The design of rail anchor 10 in the general form of a channel also provides structural advantages in addition to those noted with respect to fabrication. Comparing the rail bearing and tie bearing areas of the rail anchor of the present invention (defined by connecting web 34 and side walls 32, respectively) with those of solid spring-type rail anchors of the prior art, the tie bearing area provided by the present anchor is considerably greater for the same amount of metal employed in the solid design. Essentially, the side walls 32 have a depth greater than the thickness of the connecting web 34, hench bearing area is maximized while providing a high-strength anchor structure. Therefore, the present invention provides a more efficient anchor, more economically than the prior art.

Application of the rail anchor 10 to the rail 14 is also very simply achieved. Typically, the spring-type rail anchors are applied to the base of rail 14 by first securing the hook member 24 to a first of the laterally projecting flanges 12, and thence rotating the latch end into engagement with the opposite edge of the rail flange by a suitable tool or machine, as well known in the art. To facilitate the application of the anchor to the rail, the latch is provided with an outwardly flared end 38 for engagement with the rail and the latch is provided with a protuberant portion 35 to provide the necessary latching contact.

The hook member 24 and latch 26 are suitably dimensioned such that they firmly capture the flanges 12. That is, the throat portion 20 of the anchor is caused to be sprung open over its length by insertion of the edges of the rail within the members 24 and 26 to cause the same to positively grip the rail 14 with the bearing surfaces 28 and 30 in intimate engagement with the base surface 16 and the throat 20 in contact with a side of the tie. Similarly, the throat 20 is appropriately dimensioned in order that the opposing hook and latch members 24 and 26 must be sprung somewhat longitudinally apart for application of the anchor to the rail. After the installation process is complete, a tensional force will be exerted by virtue of the tendency of throat 20 to resume its unstressed configuration and the latch and hook to move inwardly. Accordingly, the rail anchor 10 firmly grips the base of the rail 14 in a static condition.

Dynamically, the rail anchor 10 also provides positive engagement with the rail 14 and translates any longitudinal or creeping motion to an adjacent cross-tie (not shown). As the rail tends to creep, the forces exerted by the longitudinal motion will be transferred from the abutting side wall of the rail anchor 10 to the side of the tie with which it is in contact. Insofar as there is a torsional force component which occurs as the anchor 10 tends to tilt under dynamic stress, the rounded edges 36 of the connecting web, as well as the arcuate portion thereof in the throat area 20, provide an extended surface for contact both between the anchor and the rail and the anchor and the tie.

The rail anchor 10 of the present invention is of improved construction whereby the static and dynamic holding characteristics are maintained while employing relatively less metal in the anchor. The rounded surfaces of the anchor achieve two distinct advantages: the contact surfaces are effectively extended under dynamic loading and no damage to the rail will be experienced during any movement.

While the invention has now been described with reference to certain preferred embodiments thereof, the skilled artisan will appreciate that various substitutions, omissions, changes and modifications may be made without departing from the spirit thereof. Accordingly, it is intended that the scope of the present invention be limited solely by that of the following claims:

What I claim is:

1. A one-piece spring-type rail anchor of substantially uniform wall thickness, for gripping the base of a rail having laterally projecting flanges, said anchor comprising:

(a) a downwardly bowed throat portion;

(b) a pair of generally C-shaped members for engaging the laterally projecting flanges of a rail base, said C-shaped members extending from opposing ends of said throat; and (c) a pair of rail bearing surfaces for engaging the base of said rail at spaced locations thereacross, said bearing surfaces being at the junctures of said C-shaped members and said throat; wherein said rail anchor has a generally inverted U-shaped cross-section comprised of a pair of substantially parallel side walls joined by a connecting web.

2. The rail anchor of claim 1, wherein said bearing surfaces are substantially flattened surfaces.

3. The rail anchor of claim 2, wherein said connecting web of said throat portion is upwardly curved.

4. The rail anchor of claim 1, wherein said connecting web of said C-shaped members and said bearing surfaces is a substantially flat web joining said side walls at a pair of generally rounded edges, said flat web longitudinally merging into an upwardly curved arcuate connecting web in said throat portion interiorly of said bearing surfaces.

5. The rail anchor of claim 4, wherein one of said C-shaped members has an outwardly flared end.

6. The rail anchor of claim 5, wherein the distance between said C-shaped members is somewhat less than the transverse dimension of the base of said rail.

7. The rail anchor of claim 1, wherein:

(a) a first of said C-shaped members comprises a hook member for engaging the edges of one of the flanges of said rail; and, (b) the second of said C-shaped members comprises a latch member for engaging the edges of the other, opposing flange of said rail.

8. The rail anchor of claim 7, wherein said latch member includes an inwardly directed protuberance for engaging the top edge of said flange.

9. The rail anchor of claim 1, wherein the depth of said side walls is greater than the thickness of said connecting web.

10. A one-piece spring-type rail anchor of substantially uniform wall thickness, for gripping the base of a rail having laterally projecting flanges, said anchor comprising:

(a) a throat member;

(b) a pair of generally C-shaped terminal members extending from opposing ends of said throat adapted for gripping laterally projecting flanges of a rail; and (c) bearing surface means at the juncture of said throat and terminal members for engagement with the base of said rail; wherein said rail anchor has a generally inverted U-shaped cross-section throughout.

* * * * *

UNITED STATES PATENT AND TRADEMARK OFFICE

CERTIFICATE OF CORRECTION

PATENT NO. : 4,210,281

DATED : July 1, 1980

INVENTOR(S) : Graham M. Fee

It is certified that error appears in the above-identified patent and that said Letters Patent are hereby corrected as shown below:

Column 1, Line 5, please change "expecially" to read --especially--.

Column 1, Line 27, please change "ancor" to read --anchor--.

Column 3, Line 30, please change "hood-shaped" to read --hook-shaped--.

Column 4, Line 17, please change "hench" to read --hence--.

Signed and Sealed this

*Twenty-eighth* Day of *October 1980*

[SEAL]

*Attest:*

SIDNEY A. DIAMOND

*Attesting Officer*

*Commissioner of Patents and Trademark*